US011186887B2

(12) United States Patent
Badirujjaman et al.

(10) Patent No.: US 11,186,887 B2
(45) Date of Patent: Nov. 30, 2021

(54) MULTI-TRACK LASER SURFACE HARDENING OF LOW CARBON COLD ROLLED CLOSELY ANNEALED (CRCA) GRADES OF STEELS

(71) Applicants: Tata Steel Limited, Jamshedpur (IN); International Advanced Research Centre for Powder Metallurgy and New Materials (ARCI), Hyderabad (IN)

(72) Inventors: Syed Badirujjaman, Jamshedpur (IN); Kundu Saurabh, Jamshedpur (IN); Sulthan Mohiddin Shariff, Hyderabad (IN); Gadhe Padmanabham, Hyderabad (IN); Tak Manish, Hyderabad (IN)

(73) Assignee: Tata Steel Limited, Jamshedpur (IN)

( * ) Notice: Subject to any disclaimer, the term of this patent is extended or adjusted under 35 U.S.C. 154(b) by 559 days.

(21) Appl. No.: 15/103,343

(22) PCT Filed: Dec. 10, 2014

(86) PCT No.: PCT/IN2014/000765
§ 371 (c)(1),
(2) Date: Jun. 10, 2016

(87) PCT Pub. No.: WO2015/087349
PCT Pub. Date: Jun. 18, 2015

(65) Prior Publication Data

US 2016/0312328 A1 Oct. 27, 2016

(30) Foreign Application Priority Data

Dec. 13, 2013 (IN) ..... 1411/KOL/2013

(51) Int. Cl.
*C21D 9/46* (2006.01)
*C21D 1/06* (2006.01)
(Continued)

(52) U.S. Cl.
CPC ..... *C21D 9/46* (2013.01); *C21D 1/06* (2013.01); *C21D 1/09* (2013.01); *C21D 1/26* (2013.01);
(Continued)

(58) Field of Classification Search
CPC ... C21D 1/06; C21D 1/09; C21D 9/46; C21D 9/48; C21D 10/005; C21D 2211/002; C21D 2211/008; C21D 2221/00
See application file for complete search history.

(56) References Cited

U.S. PATENT DOCUMENTS 4,533,400 A 8/1985 Benedict
4,539,461 A 9/1985 Benedict et al.
(Continued)

FOREIGN PATENT DOCUMENTS

CN 1121115 A 4/1996
CN 101225464 A 7/2008
(Continued)

OTHER PUBLICATIONS

D.I. Pantelis, E. Bouyiouri, N. Kouloumbi, P. Vassiliou, A. Koutsomichalis, "Wear and corrosion resistance of laser surface hardened structural steel," Surface & Coatings Technology, 298, 2002, pp. 125-134. (Year: 2002).*
(Continued)

*Primary Examiner* — Vanessa T. Luk
(74) *Attorney, Agent, or Firm* — The Webb Law Firm

(57) ABSTRACT

A multi-track laser beam process for surface hardening a low-carbon and low manganese steel. The process includes providing cold rolled close annealed (CRCA) steel sheets
(Continued)

having in weight percentage, C: 0.03-0.07, Mn: 0.15-0.25 or 1.4, S: 0.005-0.009, P: 0.009-0.014, Si: 0.005-0.02, Al: 0.04, V: 0.001, Nb: 0.001, and Ti: 0.002 and heating the surface of the steel sheet to an austenizing temperature using a multi-track laser beam, where, upon cooling, phase transformation of the initial microstructure to a harder dual phase structure occurs. The surface temperature of the steel sheet may be controlled based on a comparison of the on-line surface temperature effect with pre-stored data representing the desired surface temperature effect to eliminate any possibility of melting the sheet. The development of the desired microstructure of the sheet, including measurement of the hardness level and the fraction of different phases, may be periodically reviewed.

20 Claims, 9 Drawing Sheets

(51) Int. Cl.

| | |
|---|---|
| ***C21D 1/09*** | (2006.01) |
| ***C22C 38/02*** | (2006.01) |
| ***C22C 38/04*** | (2006.01) |
| ***C22C 38/06*** | (2006.01) |
| ***C22C 38/12*** | (2006.01) |
| ***C22C 38/14*** | (2006.01) |
| ***C21D 10/00*** | (2006.01) |
| ***C21D 1/56*** | (2006.01) |
| ***C21D 1/26*** | (2006.01) |
| ***C21D 1/34*** | (2006.01) |
| ***C22C 38/00*** | (2006.01) |

(52) U.S. Cl.

CPC ..... *C21D 1/34* (2013.01); *C21D 1/56* (2013.01); *C21D 10/005* (2013.01); *C22C 38/002* (2013.01); *C22C 38/02* (2013.01); *C22C 38/04* (2013.01); *C22C 38/06* (2013.01); *C22C 38/12* (2013.01); *C22C 38/14* (2013.01); *C21D 2211/002* (2013.01); *C21D 2211/008* (2013.01); *C21D 2221/10* (2013.01)

(56) References Cited

U.S. PATENT DOCUMENTS

| | | | | |
|---|---|---|---|---|
| 5,073,212 | A | 12/1991 | Frohlich | |
| 5,182,433 | A | 1/1993 | Sakamoto et al. | |
| 5,313,042 | A | 5/1994 | Matsuyama et al. | |
| 5,529,646 | A | 6/1996 | Nakajima et al. | |
| 6,139,462 | A | 10/2000 | Gage et al. | |
| 6,218,642 | B1 | 4/2001 | Christmas et al. | |
| 6,379,479 | B1 | 4/2002 | Ohbayashi et al. | |
| 6,454,877 | B1 | 9/2002 | Kumar et al. | |
| 2013/0228253 | A1* | 9/2013 | Garrison, Jr. | C21D 6/002 148/548 |
| 2014/0246129 | A1* | 9/2014 | Amtmann | C21D 9/46 148/565 |
| 2015/0030870 | A1* | 1/2015 | Ueno | C21D 8/0205 428/544 |
| 2015/0211083 | A1* | 7/2015 | Gabilondo | C22C 38/00 700/166 |
| 2015/0361530 | A1* | 12/2015 | Imanaka | C22C 38/02 72/200 |
| 2016/0076115 | A1* | 3/2016 | Zeng | C21D 1/09 148/565 |

FOREIGN PATENT DOCUMENTS

| | | | | | |
|---|---|---|---|---|---|
| EP | 0585843 | A2 | | 3/1994 | |
| EP | 0893192 | A1 | | 1/1999 | |
| EP | 2161095 | A1 | | 3/2010 | |
| IN | 201000825 | I2 | * | 11/2012 | |
| JP | 54099019 | A | * | 8/1979 | C21D 1/09 |
| JP | 59179776 | A | | 10/1984 | |
| JP | 59185723 | A | | 10/1984 | |
| WO | WO-2013013305 | A1 | * | 1/2013 | B23K 26/703 |
| WO | WO-2013133295 | A1 | * | 9/2013 | C22C 38/00 |
| WO | WO-2014037281 | A2 | * | 3/2014 | F16C 41/008 |

OTHER PUBLICATIONS

Hardness Conversions for Steels, Mechanical Testing and Evaluation (vol. 8), ASM Handbooks Online, ASM International, 2003, pp. 1-12. (Year: 2003).*

Ashby et al., "The Transformation Hardening of Steel Surfaces by Laser Beams-I. Hypo-Eutectoid Steels", Acta Metallurgica, 1984, vol. 32:11, pp. 1935-1948.

Burnham et al., "Hardening and Welding with High Power Diode Lasers", In Laser Diodes and LEDs in Industrial, Measurement, Imaging, and Sensors Applications II: resting, Packaging, and Reliability of Semiconductor Lasers, 2000, Proceedings of SPIE vol. 3945, pp. 75-84.

Jahn et al., "Local Laser Strengthening of Steel Sheets for Load Adapted Component Design in Car Body Structures", Physics Procedia, 2011, vol. 12, pp. 431-441.

Katsamas et al., "Sufrace hardening of low-alloy 15CrNi6 steel by CO2 laser beam", Surface and Coatings Technology, 1999, vol. 115, pp. 249-255.

Putatunda et al., "Influence of laser hardening on mechanical properties of a low alloy steel", Surface Engineering, 1997, vol. 13:5, pp. 407-414.

Selvan et al., "Effect of laser surface hardening on En18 (AISI 5135) steel", Journal of Materials Processing Technology, 1999, vol. 91, pp. 29-36.

Steen et al., "Laser Material Processing, 4th Ediction", 2010, Springer, London.

* cited by examiner

EDD as received

EDD-TMB

EDD-Full LSH

Type 1 Steel sample-base

Type 1 Steel sample -laser treated (as per the process of the current invention)

Before SST test

After 12 days SST

After 18 Days SST

After 24 Days SST

Coating Peel off after 24 days SST

MULTI-TRACK LASER SURFACE HARDENING OF LOW CARBON COLD ROLLED CLOSELY ANNEALED (CRCA) GRADES OF STEELS

CROSS-REFERENCE TO RELATED APPLICATIONS

This application is the United States national phase of International Application No. PCT/IN2014/000765 filed Dec. 10, 2014, and claims priority to Indian Patent Application No. 1411/KOL/2013 filed Dec. 13, 2013, the disclosures of which are hereby incorporated in their entirety by reference.

FIELD OF THE INVENTION

The current invention is related to a process of improving tensile strength of cold rolled close annealed (CRCA) grade low carbon steel using multi-track laser surface hardening method. The steel manufactured by current methods can be used for producing automotive components which require tailored properties.

BACKGROUND OF THE INVENTION

Automotive components such as A, B and C pillars, chassis arm, wheel connector, connecting rail etc. require different strength across the length of the components. A number of methods such as flame heating, induction heating etc. are established to increase surface hardening but these methods have several limitations. The surface hardening of steel using laser has attracted much attention during the past two decades.

High power laser beam of specific size can be used for surface hardening. Laser surface hardening method provides various advantages such as high degree of controllability, high reproducibility, treatment of complex areas with precision, case depth controllability, excellent amenability to automation, high processing speed etc. Furthermore, the typical shallow laser hardened zone facilitates in minimizing distortion and vast reduction or elimination of post-hardening process requirements compared to hardening techniques.

In a typical laser hardening process, a laser beam of specific power and spot size is scanned on the steel surface of a steel sheet with a specific pre-determined speed. The laser contact increases the surface temperature of steel surface to the extent of austenetization temperature and thereby, results in martensitic transformation beneath the steel surface to a certain depth.

The extent of martensite formation in the microstructure and its depth is dependent upon hardenability (chemical composition) of the steel sheet and adopted processing parameters.

The technique [1,2] of surface hardening using laser beams have been extensively utilized and commercially exploited for medium carbon and high carbon steels mainly for the applications where wear resistance improvement is required to a big extent. However, the technique is not explored for low carbon steel because hardenability of low-carbon steel is not significant to improve the surface property. Use of lasers provide precisely determined localized heat input, negligible distortion, ability to treat specific areas, access to confined areas and short cycle times.

Although, Nd:YAG (Neodymium-doped Yttrium Aluminum Garnet) and $CO_2$ laser systems have both been used for a number of years. However, these systems have limitations such as high, capital cost, perceived reliability of equipment, low wall-plug efficiency, high size of equipment, low area coverage rates and complexity of operation. These limitations have restricted their adaptability in industry. Also, such system when used with laser source for the study of surface hardening, the problems associated with high reflectance are observed as reported by Selvan et al. [3], Katsamas [4] and Putatunda et al. [5].

Ehlers et al. [2] used a 2 kW diode laser to harden medium carbon steel to achieve the case depths of up to 1 mm at speeds of 400 mm/min, although no hardness values were reported. An even energy distribution with wider spot, and a shorter wavelength produced by the diode laser, attribute many beneficial effects in using the diode laser beam for surface hardening, for instance, increased process efficiency, high coupling efficiency, high area coverage, high surface-temperature controllability, wide area processing compared to the other available laser types [2].

Most of the prior art work was however carried out on laser hardening of medium and high carbon steels using different types of lasers and laser beams. For instance, the transformation hardening of hypo-eutectoid and hypereutectoid steel surface was reported by Ashby [6], using continuous wave CO2 laser beam.

They have concluded that steels with a carbon level below 0.1% wt does not respond to laser treatment on account of poor hardenability.

Besides the above work on laser surface hardening, a number patents have also been published. For instance, patent No: CN1121115 states that Long cylinder of medium carbon steel, medium carbon alloy steel etc., were surface hardened by involving carbon-nitrogen co-cementing treatment. Similarly, Patent Nos: JP59179776 and JP59185723 used laser carburization method for surface hardening of pure Iron and low carbon steel, whereas U.S. Pat. Nos. 4,533,400, 4,539,461, 5,073,212 developed laser surface hardening method and apparatus for surface hardening of gear and to improve fatigue properties of turbine blade alloy steel. A new method was introduced namely laser quenching in the U.S. Pat. No. 5,182,433 and it was effectively used in U.S. Pat. Nos. 5,313,042 and 6,379,479. Laser phase transformation and ion implantation process were used for ferrous and non-ferrous metals to improve the hardness and corrosion resistance as patented in U.S. Pat. No. 6,454,877.

The U.S. Pat. No. 6,218,642, assigned to J. F. Helmold & Bro., Inc., discloses a method of surface hardening of steel work piece using laser beam to obtain equivalent or superior ductility with enhanced wear resistance. The selected surface areas of steel work pieces are heat treated using the laser beam to increase the hardness in the required surfaces. Laser beam of less intensity is subsequently applied, for relieving stress. Application of laser beam reduced processing time without weakening metal section and its durability. The method can be used for the cutting rules, knife blades etc.

The European patent EP2161095, assigned to Alstom Technology Ltd., discloses method of surface treatment of turbine component using laser or electron radiation. In this method the surface of the steam turbine is remelted by laser radiation or electron radiation and then surface-alloying is done to increase the mechanical stability and the corrosion resistance of the surface of the steam turbine. The method provides steam turbine part with good smoothness, high strength and high corrosion resistance thus improves the efficiency of the turbine blade. This method can be used for treating surface of a steam turbine made of austenitic or ferritic-martensitic steel.

The European patent EP0893192, assigned to Timken Co, discloses the method of imparting residual compressive stresses on steel (machine) components by inducing martensite formation in surface/subsurface microstructure. In this invention, the steel component, such as a bearing race, is locally melted using laser beam along its surface of the component. The remelted steel layer gets rapidly solidified to transform some of the austenite into martensite. Subsequently after tempering, most of the laser-treated case becomes martensitic and the solidified steel acquires a residual compressive stress due to volume expansion associated with martensite transformation. This process improves fatigue performance and crack resistance of the component and can be used to improve the physical characteristics of machine.

The Chinese patent CN101225464, assigned to Xi An Thermal Power Res. Inst., discloses an invention that relates to a method to improve the anti-oxidation performance in high temperature steam atmosphere of ferrite/martensite refractory steel. The properties of rapidly heated and rapidly cooled layer results in phase transformation with grain refinement on the steel surface. This improves chromium element diffusion from basal body to oxygenation level, thereby improving high temperature and steam oxidation resisting properties of ferrite/ferrite refractory steel.

The European patent EP0585843A2 discloses the alloying elements and microstructures suited for realizing a marked increase in strength of low-carbon or ultra-low carbon steel plate using a high-density energy source such as a laser. More particularly, the invention relates to a highly formable steel plate which can be enhanced in strength in necessary areas by laser treatment after forming or the laser treatment according to the invention can be performed prior to the forming as well.

The prior art discusses the use of laser beam hardening process for medium and high carbon steels, which have limited use in automotive industry as these steels show poor formability. In addition, it emphasizes the application of surface hardening only to improve the surface related properties (for example, wear resistance, oxidation resistance, corrosion resistance etc.). In light of the above mentioned prior art, there is need of developing a laser beam hardening process that can be used for thin low carbon steels.

SUMMARY OF THE INVENTION

An object of the invention is to improve overall strength of CRCA (cold rolled close annealed) steel sheet (low carbon) using multi-track laser surface hardening method.

Another object of the invention is to design a process with various variables like laser power, scanning speed, steel chemistry, thickness and pattern etc. that can be applicable for low carbon steel grades.

Another object of the invention is to propose a process to create a composite Structure by developing hardened layer of the steel blank by employing laser surface hardening using multi-track laser treatment on one surface.

Still another object of the invention is to propose a process to generate dual phase structure (bainite/martensite) up to a depth of 0.3 mm (millimeter) from the surface by employing laser surface hardening (LSH) of low-carbon steel.

Still another object of the invention is to develop a laser surface treatment process for the formation of a hardened layer up to a depth of 0.3 mm (millimeter) along the thickness without affecting the bulk structure.

Still another object of the invention is to develop a laser surface treatment process applicable for steel sheet products of a thickness of 1 mm or below.

Still another object of the invention is to develop a process for increasing dent/wear resistance, overall endurance limit for fatigue of the automotive components.

A surface of 500 mm×500 mm size of cold rolled close annealed (CRCA) low carbon and low manganese steel sheet is heat treated by a laser beam with the optimized process variables, (such as laser power and laser scanning speed) and self-cooled under a water cooled copper plate on which the cold rolled close annealed (CRCA) low carbon steel sheet was clamped. The laser treatment improves the overall mechanical strength of the steel sheet to make it adaptable for use in automotive components. The effects of laser beam processing (LP) on the microstructure and microhardness of the working steel sheets are recorded and tensile properties are investigated. Laser beam processing of the steel sheet results in dual phase structure with some grain refinement in the transition zone up to a certain depth on one surface. The steel sheet across the cross section consists of a hardened layer and the softer core, which accomplishes an increase in overall tensile properties (27-59% increase in YS and 20%-24% increase in UTS) in the steel sheet.

Variables

As per the current invention, the process can be applied to a CRCA steel comprising of carbon in the range of 0.04-0.07 weight % Two grades of steel were used with variable Manganese composition, one steel grade (type-1) comprising Manganese in the range of 0.15-0.25 weight % and another steel grade (type-2) comprising 1.4 weight %. The table 1 shows the chemical composition of the steel grades considered for experiments. The initial microstructure of the steel contains primarily ferritic structure. The setup utilized for laser hardening shown as schematic in FIG. 1 constitutes a diode laser beam carried by a 1500-micron optical fiber (1) and focused with the optical head (2) to produce laser beam (3) into a square spot of 4 mm×4 mm onto the surface of steel blank (4). The steel blank is fixed to the table (6) with the help of clamps (5) and the laser beam is moved at a predetermined scanning speed to result in the hardened layer at the interaction region (7). The diode laser beam is applied using several combinations of process variables to achieve a definite surface temperature for phase transformation. The process variables for laser surface hardening have been identified as 2.5-3.5 KW of laser power and a scan speed of 150-250 mm/s. These variables can be selected with respect to the desired depth of hardened layer and hardness level. The beam is moved over the clamped steel sheet surface using a 6-axis Robot with the movement of beam occurring along the axis of the square beam.

The hardened depths for CRCA steel blanks had been measured up to 200-300 μm, which have been achieved at optimum processing condition of a laser power: 2.5-3.5 KW and scan speed: 150-250 mm/s.

One type of laser beam pattern (with variations in overlapping effects between multi-tracks) is selected to create the harder layer and thus to improve the overall mechanical strength of the steel sheets as shown in FIG. 2.

Microstructure contains a combination of bainitic and/or martensitic dual phase structure (FIG. 5). This fraction of martensite was found to be enough to achieve 225-250 HV hardness level as compared to its base hardness of 90-100 HV for type1 steel, whereas, laser treated type2 steel sheet shows 280-300 HV and type3 shows 320-350 HV as compared to base hardness of 110-120 HV and 150-160 HV respectively (FIG. 3).

Surface hardening of each type of steel sheet was done on one surface. (FIG. 2). The main application of these types of sheets will be to manufacture auto-components which require tailored mechanical strength in its different locations of the component. Additionally, it will also give better wear resistance for skin panel components as the hardness level is improving by 100%.

BRIEF DESCRIPTION OF THE ACCOMPANYING DRAWINGS

DESCRIPTION OF THE INVENTION

The process of the current invention involves laser surface hardening treatment of the cold rolled closed annealed steel sheet. Further, steel used in the current invention involves carbon in the low range. The objective of using low carbon and low manganese steel is to develop desired steel composition for use in automotive components. In an embodiment of the current invention, the carbon present in the steel is in the range of 0.04-0.07 weight % and manganese in the range of 0.15-0.25 weight %. In another embodiment of the current invention, the manganese present in the steel is equal to 1.4 weight %. Table 1 shows the chemical composition of the steel grades selected for laser surface treatment according to the current invention.

TABLE 1

Chemical composition of the steel sheet used for experiments:

| Type (CRCA) | C [%] | Mn [%] | S [%] | P [%] | Si [%] | Al [%] | V [%] | Nb [%] | Ti [%] |
|---|---|---|---|---|---|---|---|---|---|
| Type1 | 0.03-0.05 | 0.15-0.25 | 0.008 | 0.009 | 0.02 | 0.04 | 0.001 | 0.001 | 0.001 |
| Type2 | 0.03-0.07 | 0.25 | 0.008 | 0.009 | 0.02 | 0.04 | 0.001 | 0.001 | 0.001 |
| Type3 | 0.04-0.08 | 1.4 | 0.005 | 0.024 | 0.02 | 0.04 | 0.001 | 0.001 | 0.001 |

The selected compositions of the steel sheets were laser treated using different laser profiles to evaluate optimized processing parameters. The process of the current invention involves heating the surface of the cold rolled close annealed (CRCA) low carbon steel sheet using a multi-track laser beam to an austenizing temperature and self-quenched for phase transformation of the initial microstructure to harder dual phase structure. The process involves tracks of laser beam overlapping in the range of 0-2 mm. In the embodiment of the invention the tracks of laser beam are overlapping preferably within 1 mm. Further, rapid cooling is achieved by using a water cooled copper plate on which the cold rolled close annealed (CRCA) low carbon steel sheet is clamped.

Table 3 below demonstrates the tensile property evaluation of the all laser treated samples. The laser power of the multi-track laser beam used for treating type1, type 2 and type 3 steel varies in the range of 1.8-3.5 KW. Further, the scanning speed of the multi-track laser beam is in the range of 100-250 mm/s. In an embodiment of the invention, the laser power of the multi-track laser beam is in the range of 2.5-3.5 KW and scanning speed of the multi-track laser beam is in the range of 150-250 mm/s. Further, surface temperature of the cold rolled close annealed (CRCA) low carbon steel sheet is restricted to eliminate any possibility of melting (This is achieved by evaluating effect of process parameters insitu surface temperature and post process analysis.).

Figures 4A, 4B, 4C:
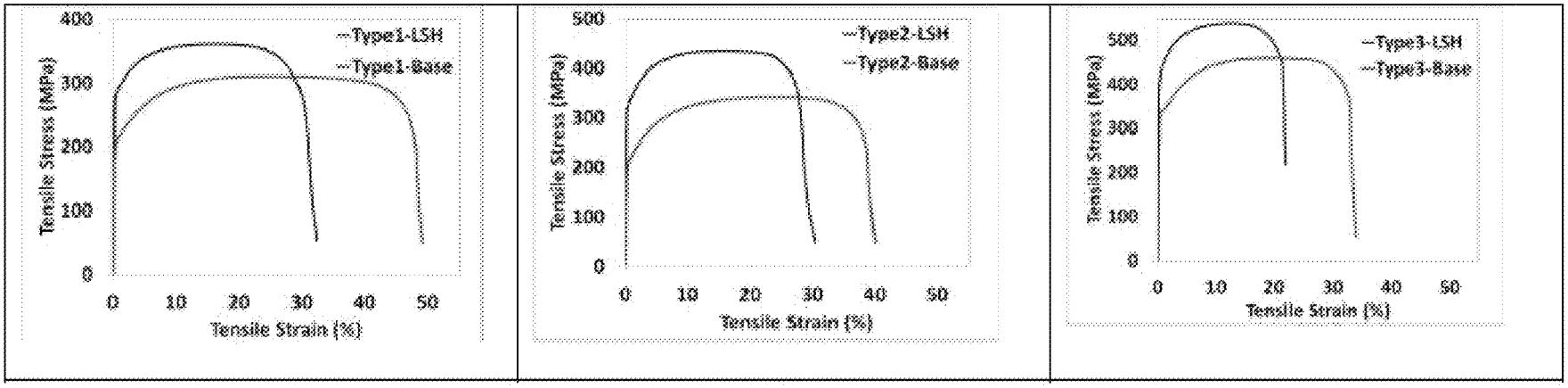
FIG. 4A is a Tensile Stress-Strain diagram a Type 1 base steel and a Type 1 steel that has been laser surface treated according to the present invention.
FIG. 4B is a Tensile Stress-Strain diagram for a Type 2 base steel and a Type 2 steel that has been laser surface treated according to the invention.
FIG. 4C is a Tensile Stress-Strain diagram for a Type 3 base steel and a Type 3 steel that has been laser surface treated according to the invention.
Figure 5A:
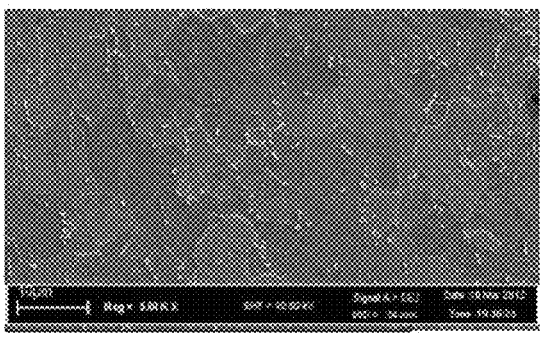
FIG. 5A is an SEM micrograph of the surface of a base Type 1 steel sheet.
Figure 5B:
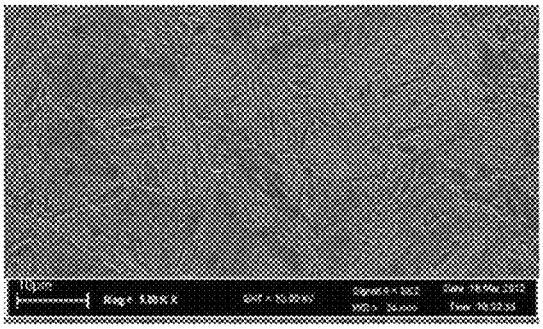
FIG. 5B is an SEM micrograph of the surface of a Type 1 steel sheet that has been laser treated according to the present invention.
Figure 5C:
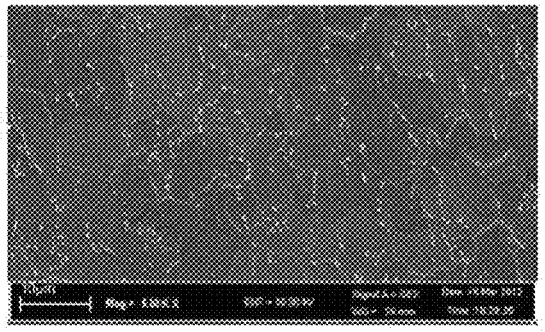
FIG. 5C is an SEM micrograph of the surface of a base Type 2 steel sheet.
Figure 5D:
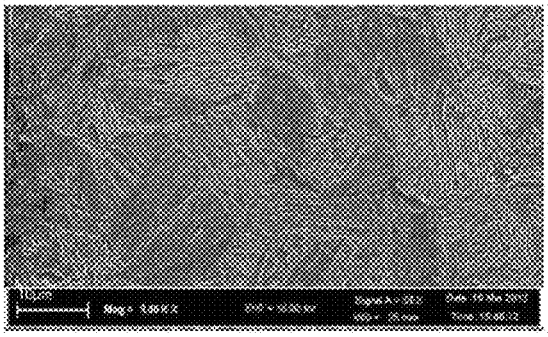
FIG. 5D is an SEM micrograph of the surface of a Type 2 steel sheet that has been laser treated according to the present invention.
Figure 5E:
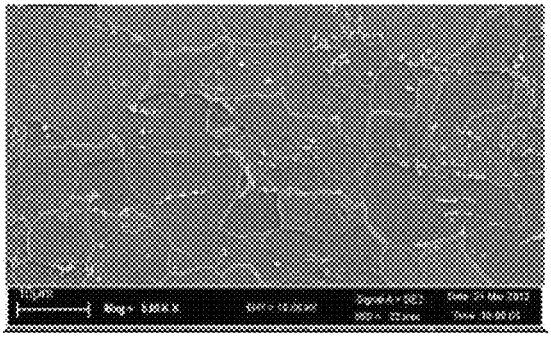
FIG. 5E is an SEM micrograph of the surface of a base Type 3 steel sheet.
Figure 5F:
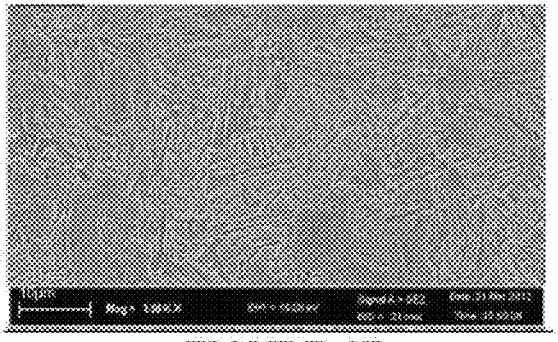
FIG. 5F is an SEM micrograph of the surface of a Type 3 steel sheet that has been laser treated according to the present invention.

The type 1 and type 2 steel contains low manganese with similar carbon contents, however tensile property of base material is different and the improvement of YS for type 2 is significant (59% increase) compared to type 1 after laser surface hardening as evident from FIG. 4 and Table 3. Increase in UTS for both grades type 1 and type 2 steel was 20% after the laser surface hardening. The type 3 though has high Mn content (1.4%) and thus higher tensile strength of base material, however, it shows lesser increase in YS (27%). The increase in UTS was around (20%). The process of the current invention resulted in more increase in YS than UTS in all the cases.

TABLE 3

Tensile property evaluation of the all laser treated samples. (LSH: Laser Surface Hardening)

| Type | YS (MPa) | UTS (MPa) | EI (%) | Remark |
|---|---|---|---|---|
| Type1-Base | 201 | 297 | 49 | Improvement |
| Type1-LSH | 283 | 361 | 34 | YS: 40%<br>UTS: 21% |
| Type2-Base | 204 | 351 | 40 | Improvement |
| Type2-LSH | 325 | 437 | 31 | YS: 59%<br>UTS: 24% |
| Type3-Base | 330 | 452 | 34 | Improvement |
| Type3-LSH | 421 | 542 | 23 | YS: 27%<br>UTS: 20% |

The process variables for laser surface hardening have been identified as 1.8-3.5 KW of laser power and a scan speed of 100-250 mm/s. In an embodiment of the invention, laser surface hardening parameters were identified as 2.5-3.5 KW of laser power and a scan speed of 150-250 mm/s Results:

Hardenability

Figure 1:
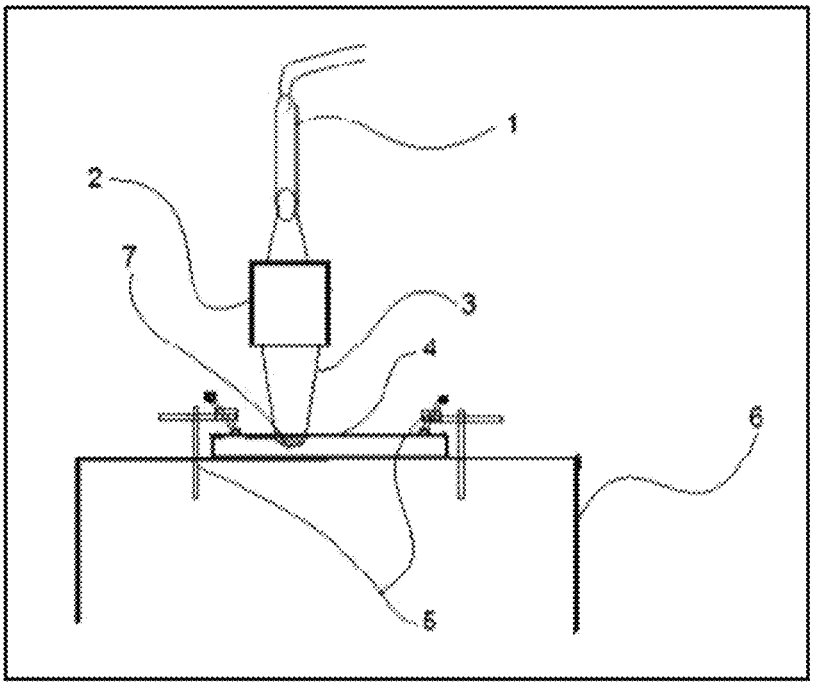
FIG. 1 is a schematic of the processing setup utilized for laser hardening of a CRCA steel sheet according to the invention (1: 1500 μm fiber carrying diode laser beam, 2: optical head for focusing laser beam, 3: 4 mm×4 mm square diode laser beam spot, 4: steel blank, 5: Clamps used for fixing steel sheet, 6: working table and 7: laser interaction region (hardened layer).
Figure 2:
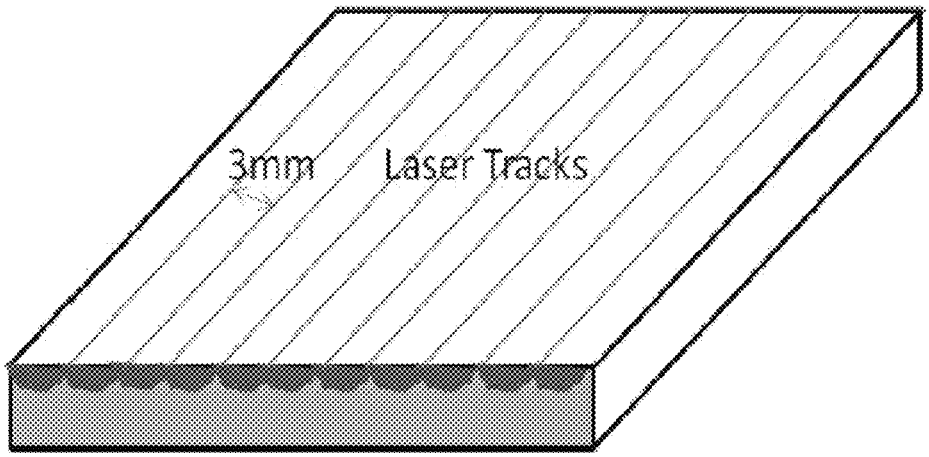
FIG. 2 is a schematic representation of laser surface treatment of the steel sheet according to the present invention.
Figures 3A, 3B, 3C:
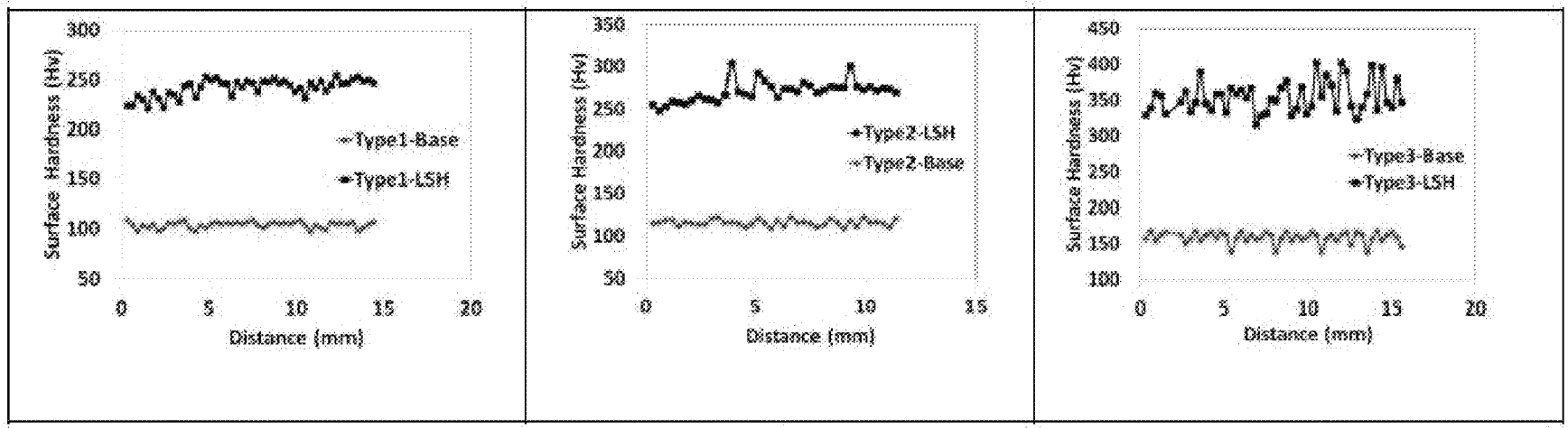
FIG. 3A is a hardness profile of the laser treated surface across the laser tracks as shown in FIG. 2 for a Type 1 steel that has been laser treated according to the present invention.
FIG. 3B is a hardness profile of the laser treated surface across the laser tracks shown in FIG. 2 for the Type 2 steel that has been laser treated according to the present invention.
FIG. 3C is a hardness profile of the laser treated surface across the laser tracks shown in FIG. 2 for the Type 3 steel that has been laser treated according to the present invention.

The surface microstructure of the laser treated area is illustrated in FIG. 5. At the same time, hardness profile was taken across multi-tracks of laser treated area on the surface and is presented in FIG. 3. The hardness level increased to 225-250 HV as compared to its base hardness of 90-100 HV for type1 steel, whereas, laser treated type 2 steel sheet shows 280-300 HV and type3 shows 320-350 HV as compared to base hardness of 110-120 HV and 150-160 HV respectively (FIG. 3). The SEM micrograph shown in FIG. 5 indicates the formation of hard dual phases (bainite and martensite) which are responsible for the increased hardness values.

Formability

Formability Test

Figure 6A:
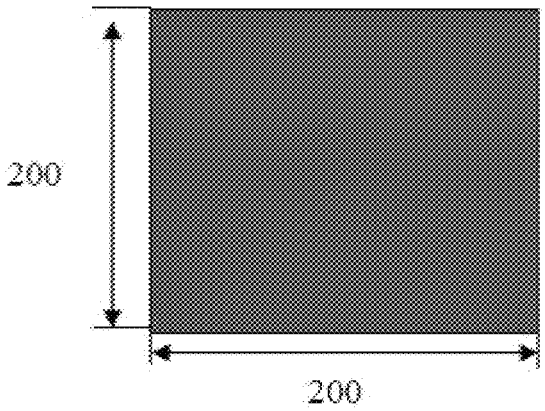
FIG. 6A is a schematic showing the shape and dimensions for the base steel blank used in the LDH test.
Figure 6B:
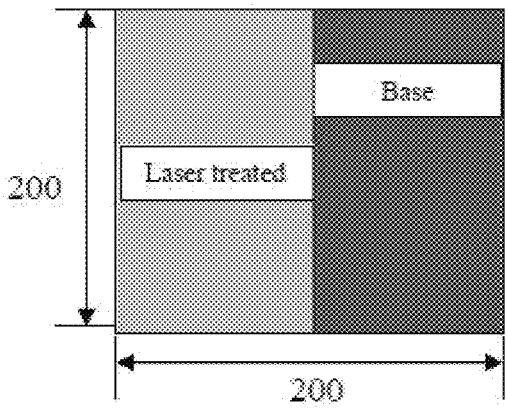
FIG. 6B is a schematic showing the shape and dimensions for the laser treated steel blank used in the LDH test.
Figure 6C:
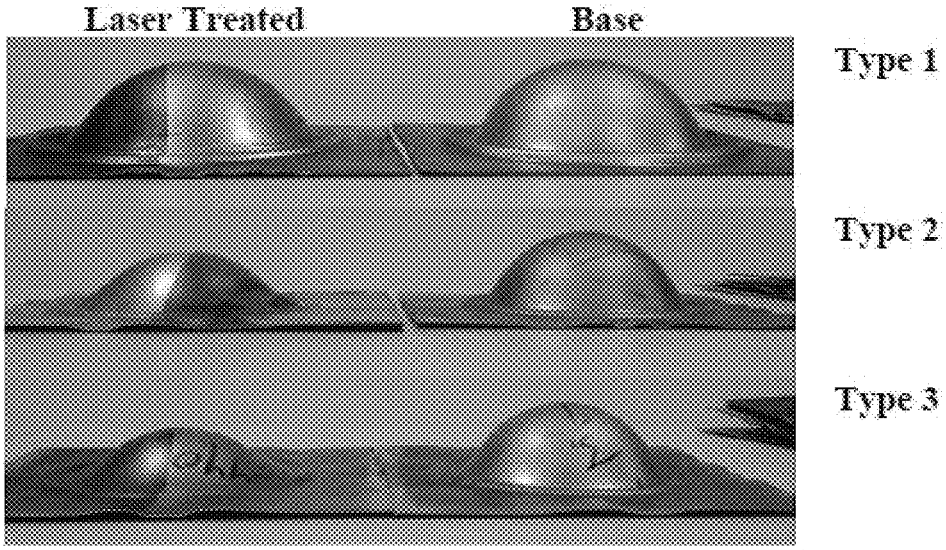
FIG. 6C is a photograph of the blanks of FIGS. 6A and 6B for the Type 1, Type 2, and Type 3 steels after LDH testing.
Figure 7:
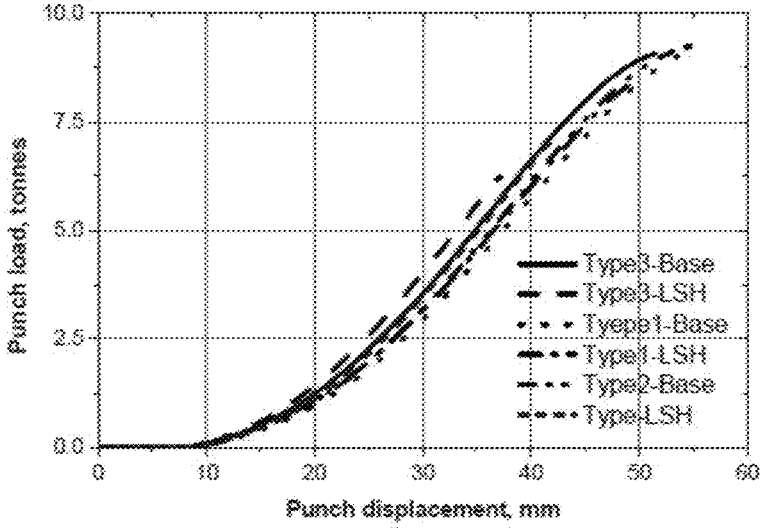
FIG. 7 is a graph showing the punch load as a function of punch displacement for both base Type 1, Type 2, and Type 3 steels and Type 1, Type 2, and Type 3 steels that have been laser treated according to the present invention.

Dome test was carried out on base and laser treated blanks of three different grades: a) Type 1 b) Type 2 and c) Type 3. Blank size was 200 mm×200 mm as shown in FIG. 6. In case of laser treated blanks, the half portion of the blank was treated as shown below. Dome test was carried by a servo-hydraulic forming press. The punch speed was 1.0 mm per second and the blank holding force was 120 kN. It can be seen that the load for CMn 440 is highest followed by DQ and then EDD. This is in line with the expectation as the strengths of base material were in that order only. FIG. 7 shows the Punch force Vs-Punch displacement for laser treated blanks and it can be seen that in this case also the trend follows the same sequence. FIG. 6*c* shows the comparison between base and laser treated blanks for the three steel grades and it can be seen that for all the steel grades the punch load for laser treated blanks are higher compared to that of the base blank signifying the strength increase due to laser treatment.

Formability Test on B-Pillar

Figure 8A:
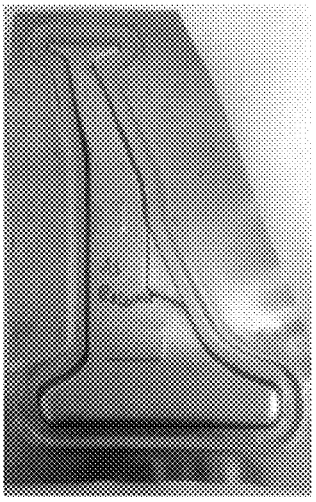
FIG. 8A is photograph of a B pillar made of Type 1 steel.
Figure 8B:
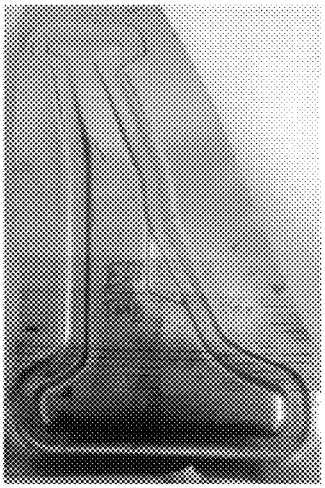
FIG. 8B is a photograph of a B pillar made of Type 1 steel having a tailored microstructure.
Figure 8C:
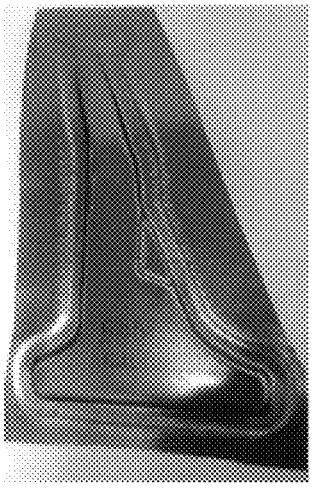
FIG. 8C is a photograph of a B pillar made of Type 1 steel fully hardened by laser treatment according to the present invention.

B-pillar was selected as it is one of the components which require variable strength. The forming was carried on the same double action hydraulic forming press. FIG. 8 shows the prototype of the formed component.

Painting Test:

Zinc phosphate treatments for the automobile industry determine the paint adhesiveness and influence the corrosion resistance of the automobile body. We have studied the Zinc phosphability and the cathodic electro deposition (CED) coating on base of Type 1 and Laser treated Type 1 steel substrate. From the different experimental analysis, it can be concluded that on base-Type 1 steel phosphating provides small crystal with uniform coverage. Whereas Laser treated type 1 steel sheet provides large-leaf shape crystal. But both the samples i.e. with and without laser treated Type 1 phosphate sheet provides almost similar performance after CED coating. In both the cases CED coated samples provide good mechanical, adhesion and corrosion resistance properties.

Physical Properties of CED Coating

The result on physical properties of CED films has been tabulated in table 9 i.e., no square was lifted by the cross-hatch test. Hardness of the CED film of this adduct can also be said to be good, as indicated by scratch hardness and pencil hardness as shown in table 4.

TABLE 4

Coating properties of 3 mint CED coating at 180 V

| Parameter | Type 1 Steel phosphating | Laser-treated Type 1 Steel phosphating |
|---|---|---|
| X-cut adhesion | 5-B | 5-B |
| Pencil Hardness | 5H | 5H |
| Scratch Hardness | 1500 | 1500 |

Salt Spray Test

TABLE 5

Salt spray test result of CED coated sample

| Sample Name | 7 days | After 14 days | After 24 days |
|---|---|---|---|
| Type1 Steel | No change | No blister, no creepage (red rust on scribe area) | 1-2 micro blister, 1-2 mm creepage on scribe area |
| Laser-treated Type1 Steel | No change | No blister, no creepage (red rust on scribe area) | No blister, no creepage. |

No Change*: No Blister, no Creepage

Figure 9:
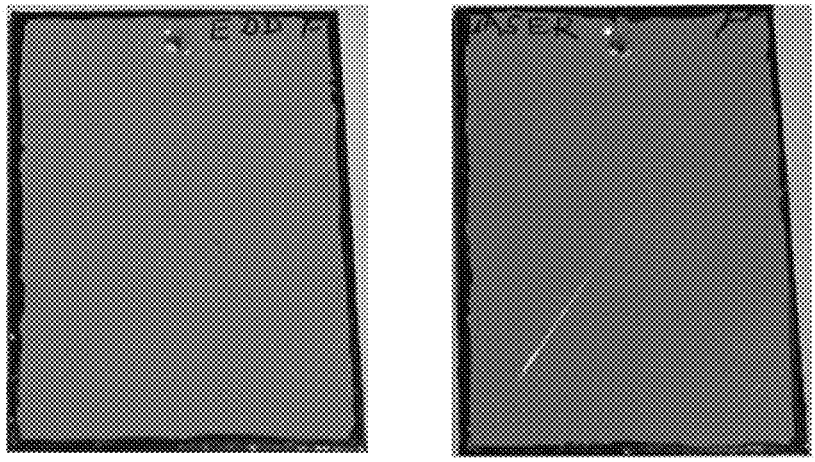
FIG. 9 is photographs of a base Type 1 steel and a Type 1 steel that has been laser treated according to the present invention.
Figure 9:
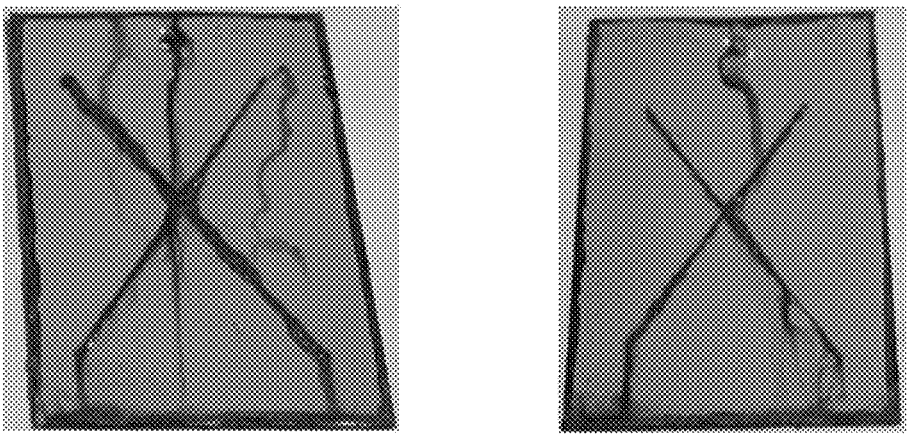
Figure 9:
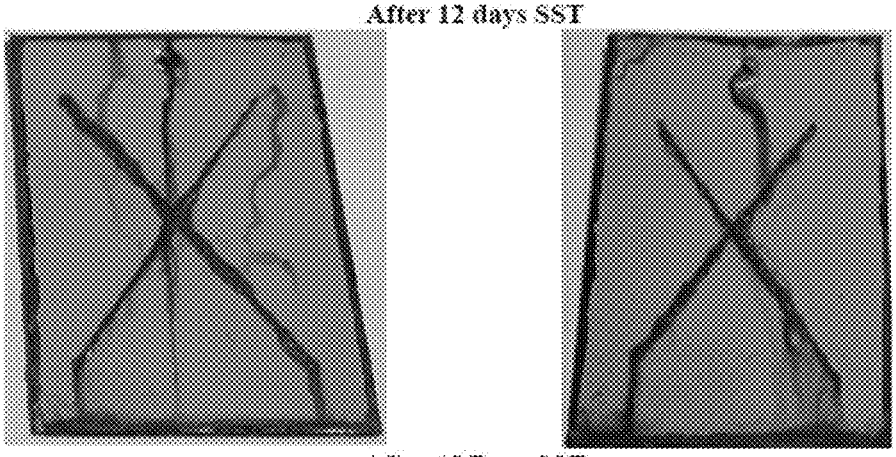
Figure 9:
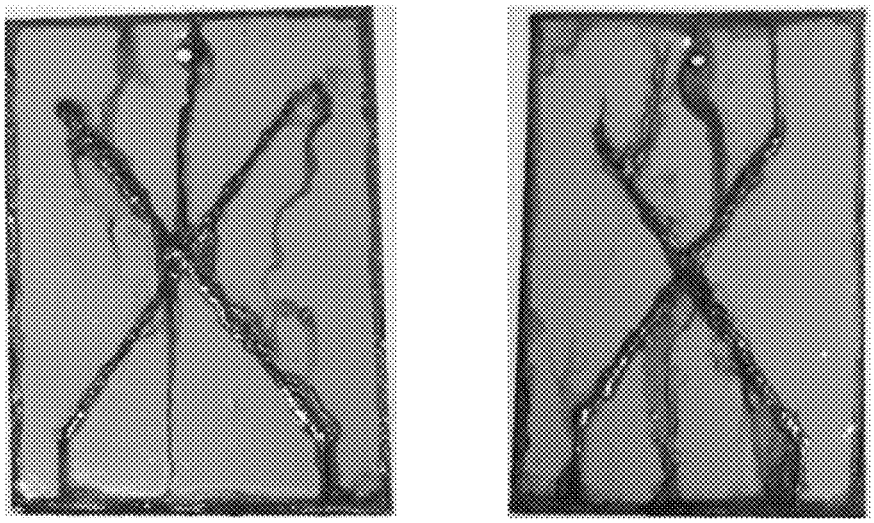
Figure 9:
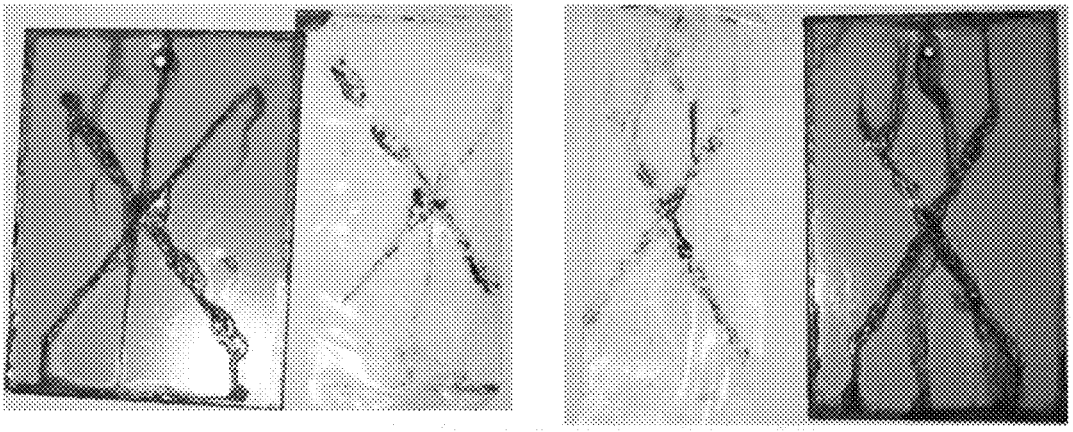

Painted panels (base sample and laser treated samples) with scribe on the surface were exposed in ASTM B117 test chamber. At regular interval of time, panels were withdrawn from the test cabinet and visually check for any types of degradation or damage happened on coated surface. Soon after the check, panels were inserted back into the ASTM B 117 test chamber. From the salt spray test result it has been observed that, initially CED coating on type 1 steel and laser treated type 1 steel sample provide almost similar corrosion performance (FIG. 9). But after 24 days of exposure some micro blister and under film creepage was observed on scribe area. Whereas laser treated type 1 steel CED sample showing good corrosion resistance even after 24 days of exposure in SST chamber. There was no blister or under film corrosion observed on laser treated type 1 steel sample.

Figure 10:
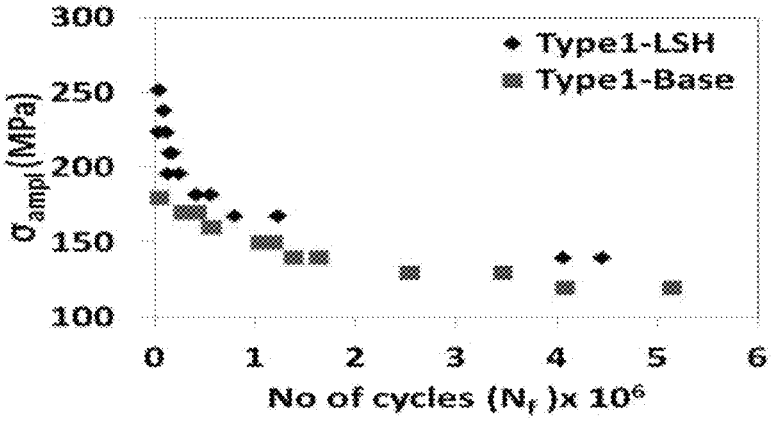
FIG. 10 is an S-N curve showing the fatigue limit of for a Type 1 base steel and a Type 1 steel that has been laser surface hardened (LSH) according the present invention.

Fatigue Property Evaluation:

a) S-N Curve to Determine Fatigue Limit:

High cycle fatigue tests were conducted for Type 1 base steel and the type 1 laser treated steel under the following test parameters and plotted S-N curve to evaluate the fatigue life of both the materials for comparison. R=−1, Sinus waveform, Frequency: 20 Hz No. of cycle to failure vs. the amplitude as depicted in FIG. 10 shows that type1-laser treated steel sheets have better fatigue life compared with the type1-base steel. The endurance limit for type1-base material was obtained in the stress level of 60% of its YS, i.e. 120 MPa, whereas endurance limit for type1-laser treated steel sample is in the stress level of 50% of its YS, i.e. 140 MPa. As the YS of laser treated materials are higher than the base material, the fatigue resistance of the former one is superior.

Figure 11:
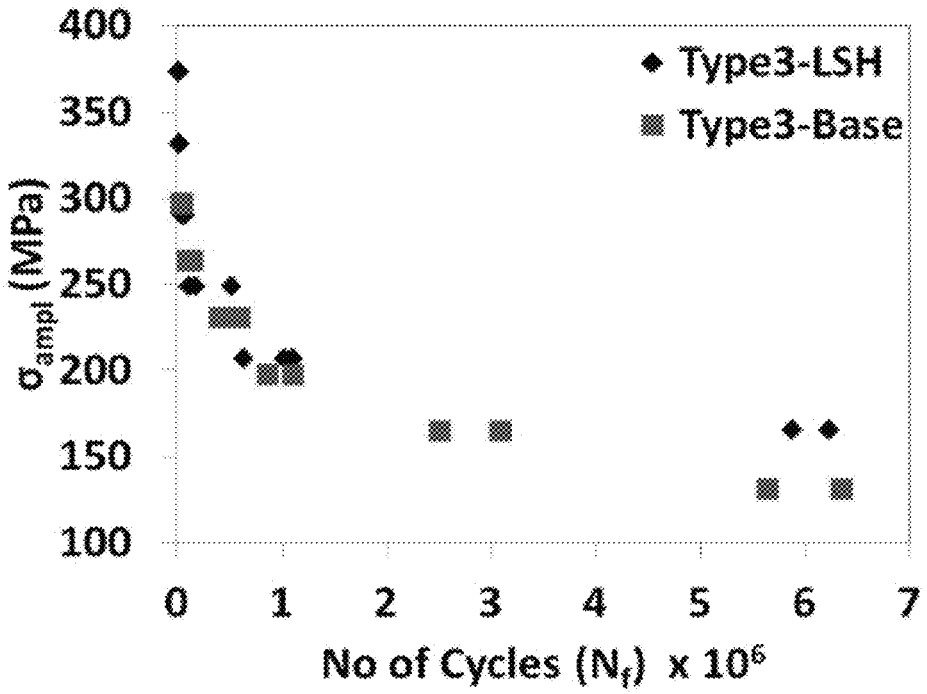
FIG. 11 is an S-N curve showing the fatigue limit of for a Type 3 base steel and a Type 3 steel that has been laser surface hardened (LSH) according the present invention.

Similarly, laser treated type3 grade of steel sheets show the endurance limit at stress level of 40% of YS, whereas for type3-base steel sample the same is 50% of YS (FIG. 11). Nevertheless, YS of laser surface treated material is 420 MPa, and for base material is 330 MPa. Therefore, the stress level of endurance limit of laser treated material will be marginally higher than that of base materials. These results suggest that for type3 grade of steel, fatigue resistance is not increasing as much as compared to the type1-laser treated material.

Figure 12:
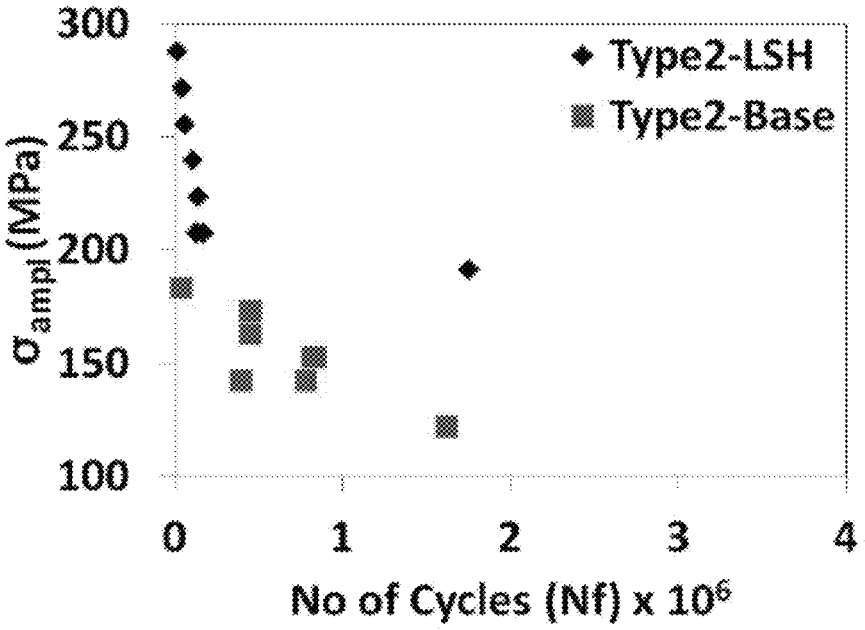
FIG. 12 is an S-N curve showing the fatigue limit of for a Type 2 base steel and a Type 2 steel that has been laser surface hardened (LSH) according the present invention.

S-N curve for type2 base steel sample and laser treated type2 steel was generated to evaluate its endurance limit as shown in FIG. 12. No. of cycle to failure for type 2 steel is very scattered, however, the stress level of endurance limit is the 60% of YS in the both cases. The no. of cycles to failure for laser treated type2 steel material drops sharply. YS of laser treated type2 steel increases 60% as compared to the type2 base materials.

The process of the current invention offers significant advantages in light of the prior art. The process can be used for laser hardening of low carbon steel that have good formability and hence, can be used for automotive components. The process further results in increasing dent/wear resistance, overall endurance limit for fatigue of the treated steel sheets as evident from the various experimental results described above. The process further results in increasing hardening of the steel sheets and hence can be used for building components which need different strength along the length of the components.

REFERENCES

1. W. M. Steen, Laser Material Processing, Springer, London 1991.
2. B. Ehlers, et al., Proceedings of the ICALEO, Section G, 1998, pp. 75-84.
3. J. Selvan, et al., J. Mater. Process. Technol. 91 (1) (1999) 29-36.
4. A. I. Katsamas, Surf. Coat. Technol. 115 (2) (1999) 249-255.
5. S. K. Putatunda, et al., Surf. Eng. 13 (5) (1997) 407-414.
6. M. F. Ashby et al., Acta Metall. Vol. 32, No. 11. (1984), 1935-1948.
7. Patent No: CN1121115, Surface hardening treatment method for inner wall of long cylinder, 1996-04-24.
8. Patent No: JP59179776, Surface hardening method by carburization hardening of pure Iron and low carbon steel by laser, 1984-10-12.
9. Patent No: JP59185723, Low strain surface hardening method of cold worked parts, 1984-10-22.

We claim:

1. A process for increasing tensile and fatigue strength of a cold rolled close annealed (CRCA) low carbon steel sheet, the process comprising:

heating a surface of the cold rolled close annealed (CRCA) low carbon steel sheet to an austenitizing temperature using a multi-track laser beam; and rapidly cooling the steel sheet for phase transformation of an initial microstructure to a harder dual phase structure, wherein a surface temperature of the cold rolled close annealed (CRCA) low carbon steel sheet is controlled such that the surface temperature does not exceed a melting temperature of the cold rolled close annealed (CRCA) low carbon steel sheet, and wherein after cooling, a yield strength and a tensile strength of the cold rolled close annealed (CRCA) low carbon steel sheet are increased by 27-59% and 20-24%, respectively.

2. The process as claimed in claim 1, wherein tracks of the laser beam are overlapped by 0-2 mm.

3. The process as claimed in claim 1, wherein tracks of the laser beam are overlapped by 1 mm or less.

4. The process as claimed in claim 1, wherein the cold rolled close annealed (CRCA) low carbon steel sheet comprises 0.03-0.07 weight % carbon.

5. The process as claimed in claim 1, wherein the cold rolled close annealed (CRCA) low carbon steel sheet composition comprises (wt %) Carbon: 0.03-0.08, Manganese: 0.15-0.25, Sulphur: 0.005-0.008, Phosphorous: 0.009-0.024, and Silicon: 0.005-0.02, Aluminium: 0.04, Vanadium: 0.001, Niobium: 0.001, Titanium: 0.002, with the remainder Iron (Fe).

6. The process as claimed in claim 1, wherein a laser power of the multi-track laser beam is 1.8-3.5 KW.

7. The process as claimed in claim 1, wherein a scanning speed of the multi-track laser beam is 100-250 mm/s.

8. The process as claimed in claim 1, wherein a laser power of the multi-track laser beam is 2.5-3.5 KW.

9. The process as claimed in claim 1, wherein a scanning speed of the multi-track laser beam is 150-250 mm/s.

10. The process as claimed in claim 1, wherein rapid cooling of the cold rolled close annealed (CRCA) low carbon steel sheet is provided by a water cooled copper plate on which the cold rolled close annealed (CRCA) low carbon steel sheet is clamped.

11. The process as claimed in claim 1, wherein the initial microstructure of the cold rolled close annealed (CRCA) low carbon steel is ferrite.

12. The process as claimed in claim 1, wherein the cold rolled close annealed (CRCA) low carbon steel sheet has a thickness of 1 mm or less.

13. The process as claimed in claim 1, wherein, after cooling, the cold rolled close annealed (CRCA) low carbon steel sheet comprises a harder dual phase structure with a hardened layer up to a depth of 0.3 mm.

14. The process as claimed in claim 1, wherein, after cooling, the cold rolled close annealed (CRCA) low carbon steel sheet comprises a harder dual phase structure with a hardened layer depth of 200-300 μm.

15. The process as claimed in claim 1, wherein, after cooling, a fatigue strength of the cold rolled close annealed (CRCA) low carbon steel sheet is 60% of a yield strength of the cold rolled close annealed (CRCA) low carbon steel sheet.

16. The process as claimed in claim 1, wherein, after cooling, a fatigue strength of the cold rolled close annealed (CRCA) low carbon steel sheet is at least 50% of a yield strength of the cold rolled close annealed (CRCA) low carbon steel sheet.

17. A process for increasing tensile and fatigue strength of a cold rolled close annealed (CRCA) low carbon steel sheet, the process comprising:

heating a surface of the cold rolled close annealed (CRCA) low carbon steel sheet to an austenitizing temperature using a multi-track laser beam; and rapidly cooling the steel sheet for phase transformation of an initial microstructure to a harder dual phase structure, wherein a surface temperature of the cold rolled close annealed (CRCA) low carbon steel sheet is controlled such that the surface temperature does not exceed a melting temperature of the cold rolled close annealed (CRCA) low carbon steel sheet, and wherein the cold rolled close annealed (CRCA) low carbon steel sheet composition comprises (wt %) Carbon: 0.03-0.08, Manganese: 0.15-0.25, Sulphur: 0.005-0.008, Phosphorous: 0.009-0.024, Silicon: 0.005-0.02, Aluminium: 0.04, Vanadium: 0.001, Niobium: 0.001, and Titanium: 0.002, with the remainder Iron (Fe).

18. The process as claimed in claim 17, wherein tracks of the laser beam are overlapped by 0-2 mm.

19. The process as claimed in claim 17, wherein tracks of the laser beam are overlapped by 1 mm or less.

20. The process as claimed in claim 17, wherein a scanning speed of the multi-track laser beam is 150-250 mm/s.

* * * * *